United States Patent [19]

Kull

[11] 3,991,907

[45] Nov. 16, 1976

[54] SOLID MERCHANDISE DISPENSING SYSTEM FOR MECHANICAL OR ELECTRICAL CONTROL

[76] Inventor: Leo Kull, 58 Westover Ave., West Caldwell, N.J. 07006

[22] Filed: June 2, 1975

[21] Appl. No.: 583,181

[52] U.S. Cl. ..... 221/84; 221/125; 221/129; 221/295; 221/301; 317/137

[51] Int. Cl.[2] ..... G07F 11/00

[58] Field of Search ..... 221/123, 124, 125, 126, 221/127, 128, 129, 84, 85, 299, 301, 289, 295, 247, 251; 317/137, 157

[56] References Cited

UNITED STATES PATENTS

| | | | |
|---|---|---|---|
| 3,464,589 | 9/1969 | Oden | 221/295 |
| 3,472,424 | 10/1969 | Offutt et al. | 221/129 |
| 3,733,007 | 5/1973 | Ungerman et al. | 221/295 |
| 3,870,135 | 3/1975 | Allen | 221/129 |

*Primary Examiner*—Allen N. Knowles

[57] ABSTRACT

A dispensing and control system, adaptable to coin operated vending machines, for selective operation of one of the dispensers acting as a means for releasing and dropping a selected merchandise to a delivery location using a mechanical or electrical control. Three dispenser mechanisms, suitable for different merchandise groups, are operable by a low power operating stroke suitable for a fully mechanical machine where the operating power comes from the manual actuation of operating knobs which are visually and mechanically linked to individual dispensers. Same dispensers are operable by an electrical power source using a novel selection system which includes a coupling and resetting control for coupling a selected dispenser actuator to a common power driven actuating member. The electrical control system is utilizing a series connected simple selection switch unit and a compact drive mechanism where the power of a single motor in a machine can be coupled to any dispenser unit which includes a small electrical actuator and switching means to control the selective coupling and resetting action. The control system is adaptable to vending machines or selection mechanisms requiring a selectable coupling of a power stroke to one of the selected actuators. The basic electrical control system is adaptable to various modifications including a direct solenoid actuation of some light acting dispensers. A two pivot escapement principle is applied as a bases for a delivery door and for one of the dispensers.

34 Claims, 34 Drawing Figures

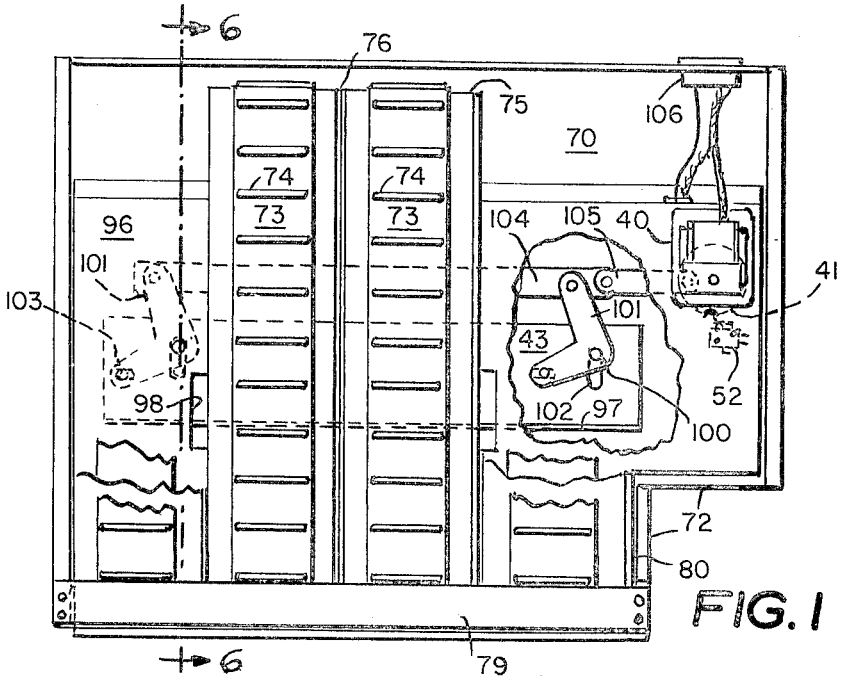
FIG. 1
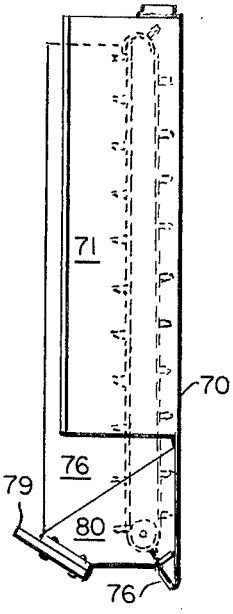
FIG. 2
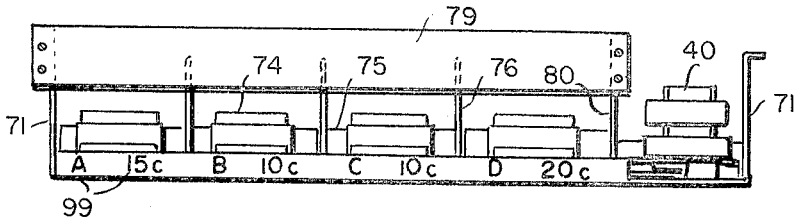
FIG. 3
FIG. 4
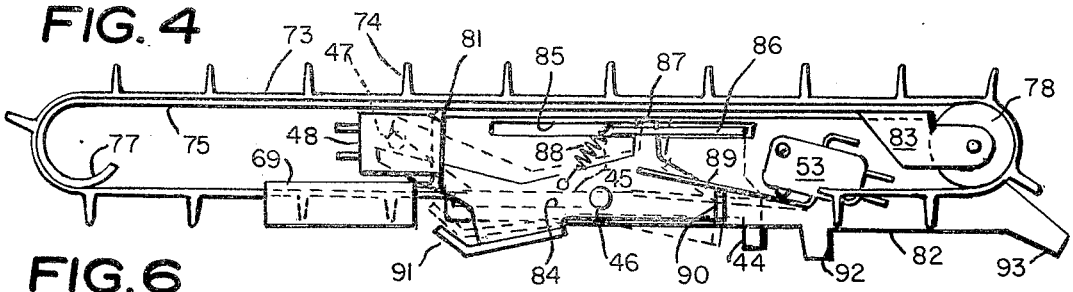
FIG. 6
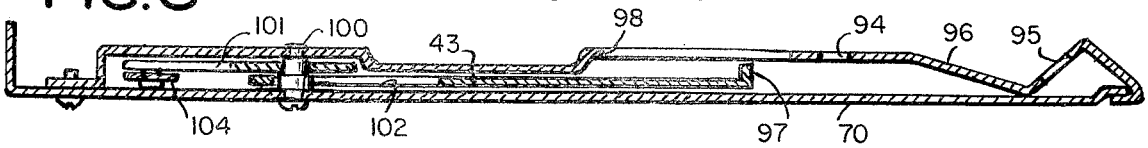
FIG. 5
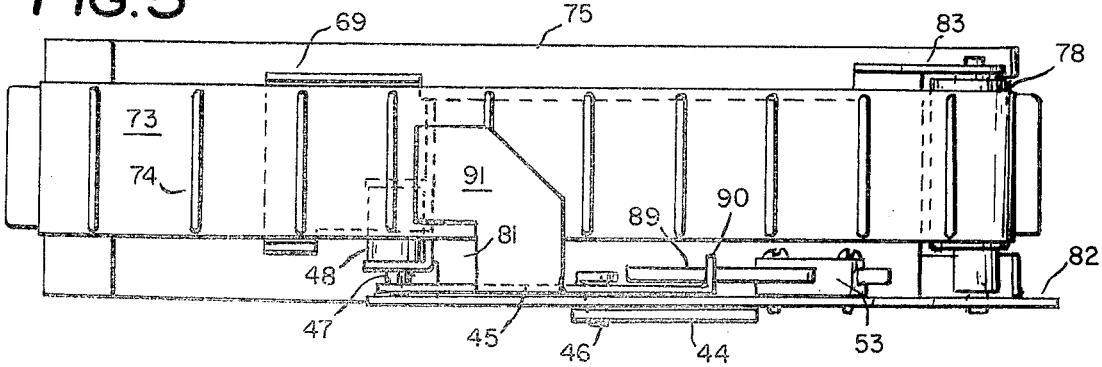

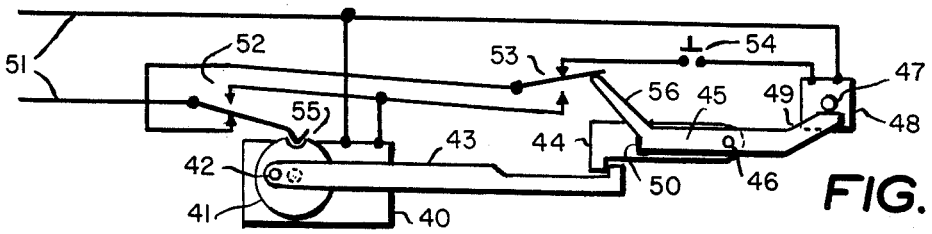
FIG. 11-A
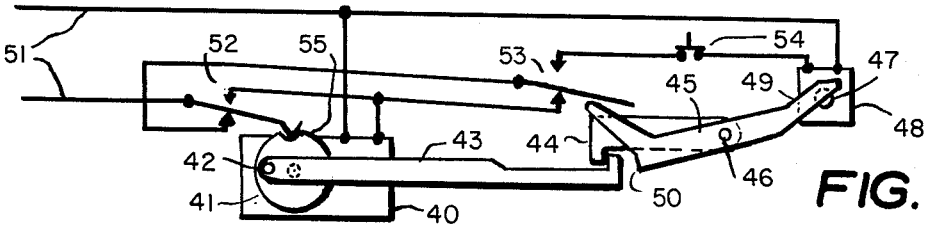
FIG. 11-B
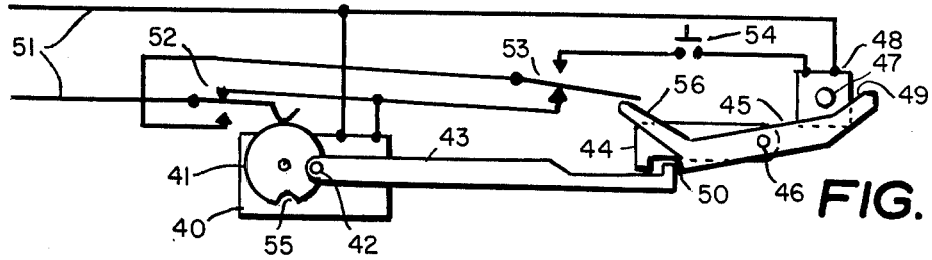
FIG. 11-C
FIG. 12
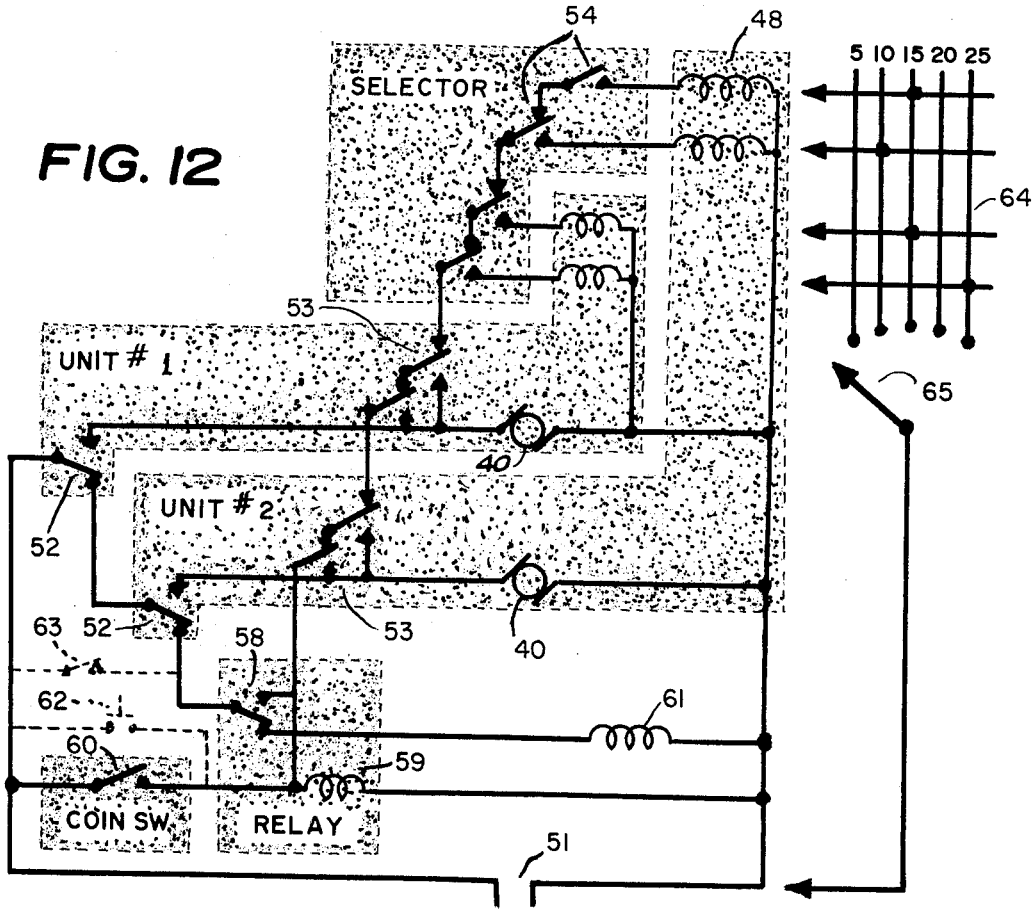

FIG. 15
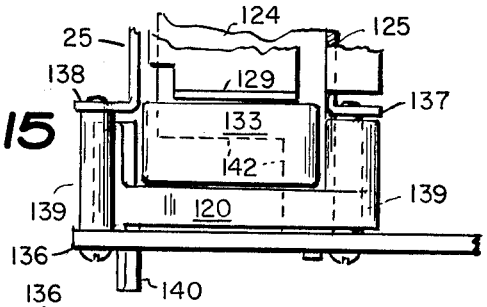
FIG. 14
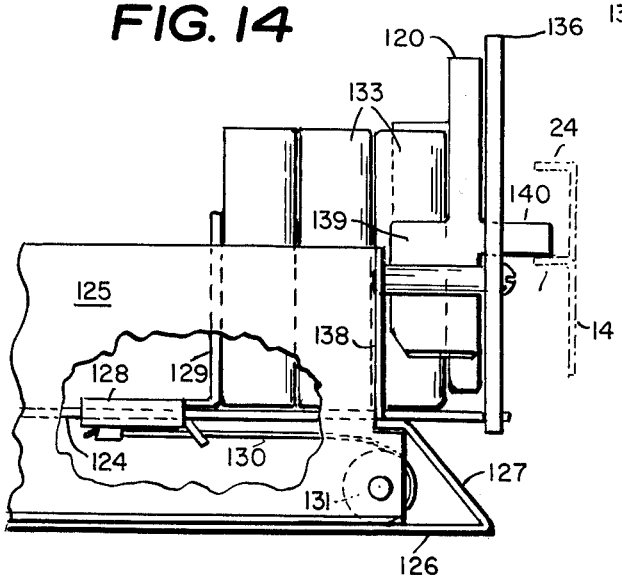
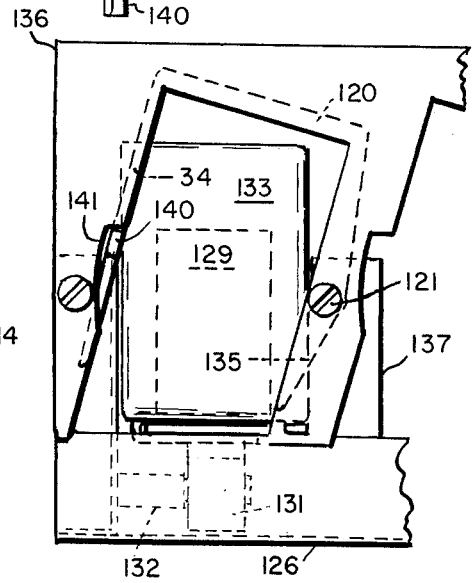
FIG. 13
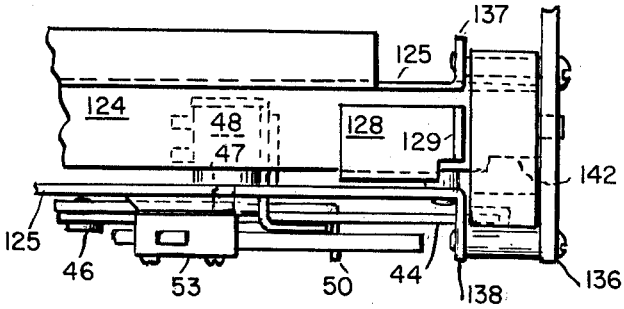
FIG. 18
FIG. 16
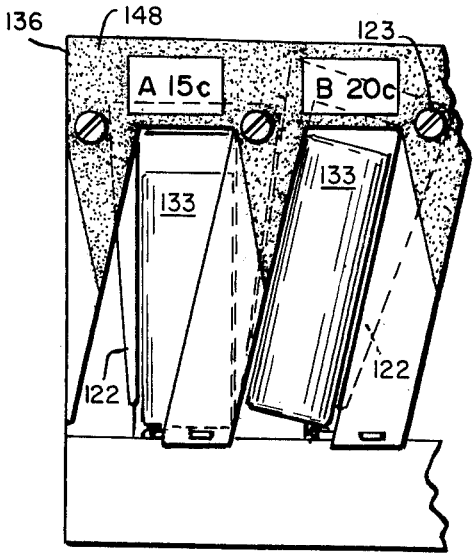
FIG. 17
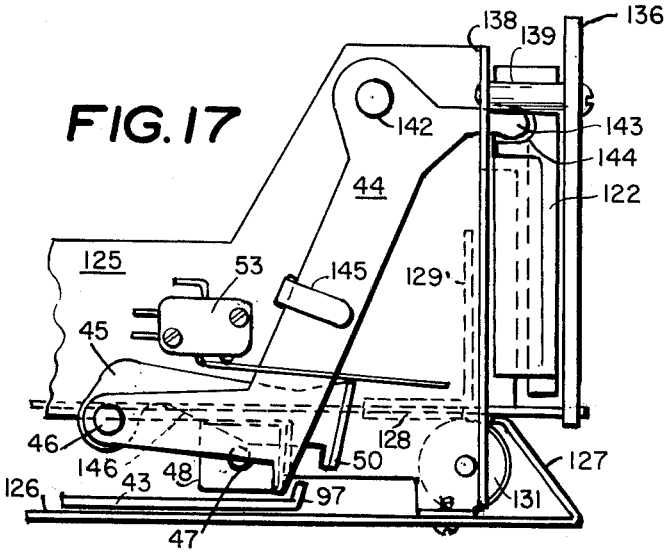

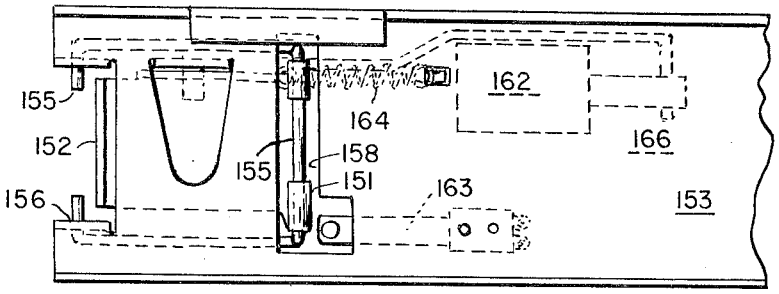
FIG. 21
FIG. 20
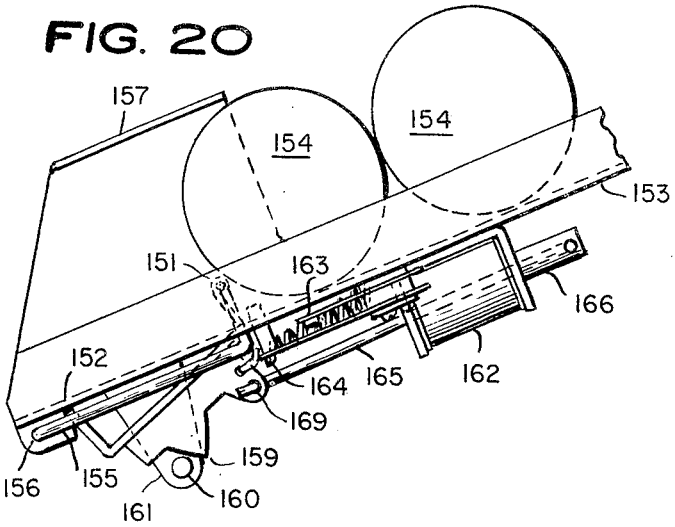
FIG. 19-A
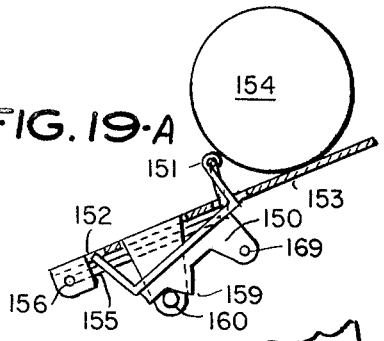
FIG. 19-B
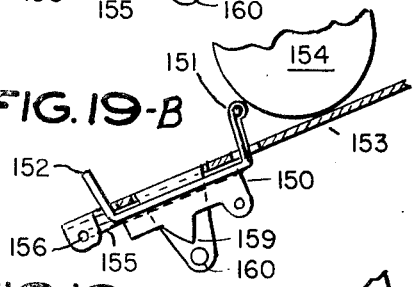
FIG. 19-C
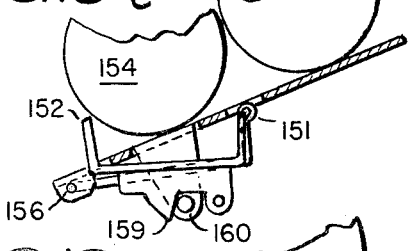
FIG. 19-D
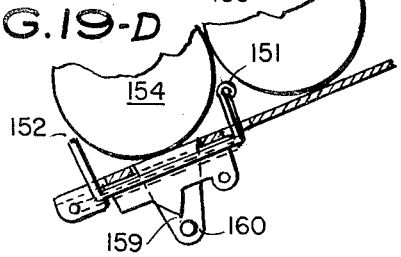
FIG. 22
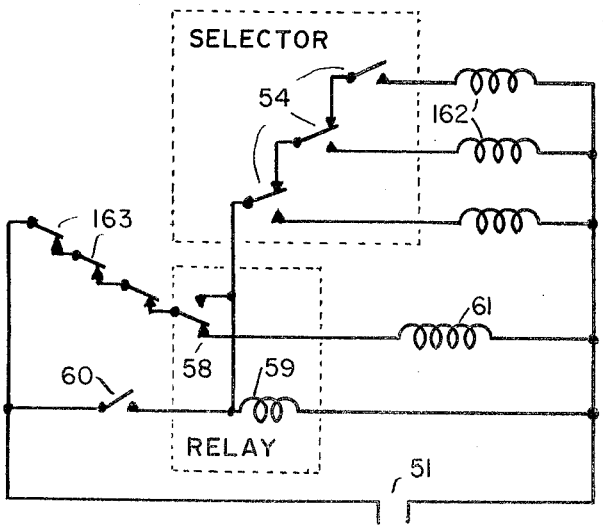

SOLID MERCHANDISE DISPENSING SYSTEM FOR MECHANICAL OR ELECTRICAL CONTROL

Because the shape and size of the merchandise containers in this group of vending machines varies considerably, it is not practical to design a universal machine to handle all the variables. The obvious reason for all this is a considerable waste of storage space in a vending cabinet if small articles are used in a storage space reserved for the largest size. The practical solution here is to provide different storage and dispensing methods for merchandise groups having something in common. The existing dispensing methods for these groups are varying so greatly that they cannot be organized to a system with enough similarity in order to meet economic and maintenence preferances.

This invention is providing three different dispensing methods, all operable by a light power stroke which makes them very suitable for mechanical or electrical control while a horizontal or slightly inclinded storage tray enables an arrangement in a cabinet where all the foremost articles in merchandise columns are visible through a display window in the front face of the vending cabinet. This arrangement offers the best eye appeal to the customer and eliminates the need for extra display boxes, empty signalling and empty locking. It further enables a slidable shelf arrangement in the cabinet for easy loading and a possibility of loading a column with different merchandise brands.

The placement of the dispensible merchandise next to a display window, however, dictates the use of a barrier door to prevent pilfering. This invention is applying a two-pivot escapement principle to control the restricted movement of the barrier door in a delivery box. The single door is replacing the existing two door arrangements which require a costlier connecting linkage and are harder to operate.

For mechanical machines the invention provides a conveyor belt-like dispenser to dispense a variety of merchandise shapes over its front end, a shuttling frame dispenser as the most suitable for rectangular shape merchandise like cigarette and gum packages and a dispenser for rolling cylindrical shapes. All of these dispensers have a similar operating lever which can be conveniently coupled to mechanical control mechanisms. For shelf and display window type of cabinets, however, the vertically operated control mechanism, as claimed in my U.S. Pat. No. 3,713,562 can offer the most compact and simplest arrangement.

Same three dispensing mechanisms are operable by a novel electromechanical control system which is using a single electrical motor for a machine or one per each dispenser tray as the most practical arrangement. The control mechanism is featuring a switch and solenoid controlled coupling method which enables to use a simple series connected selection switch unit. The drive and coupling mechanism offers extreme compactness and flexibility for fitting it invisibly underneath and inbetween merchandise storage compartments.

The invention further provides a coupling method to drive a positive 120° indexing mechanism as fully described in my U.S. application Ser. No. 583,182, filed June 2, 1975. This wide angle indexing drive is suitable for driving indexable dispensers among which the most widely known are the vertical belt dispensers and the feedcoil dispensers where a 3 to 1 speedup gearing can be used to get the required full revolution rotation.

The space in a vending cabinet is used for three different purposes: storage of merchandise, dispensing and control of dispensing. It is the storage space which gives a capacity figure to a vending machine and obviously it is very desirable to have a large storage capacity in a given cabinet size. This could be expressed as a product to cabinet or PC ratio which can be derived by dividing the total full storage merchandise volume to the volume of the vending cabinet. This means for instance that a widely known feedcoil dispenser can have an acceptable PC ratio if it is dispensing bagged products which are filling the storage space well but if cigarette packages or thin candy bars are used in a feedcoil dispenser, the PC ratio will be rather low as compared to the more compact dispensers of this invention.

The similarity of dispenser actuation and the front end dispensing from dispenser trays makes possible a modular building blockarrangement where same mechanical or electrical control system can operate different dispensers assembled in any combination to satisfy the marketing trends while still maintaining a satisfactory PC ratio.

Thus the main object of the invention is to provide a dispensing system for solid merchandise including three different dispensing principles with similar low power actuators operable by a common mechanical or electrical control system.

Another object is to provide an electrical control logic suitable for a coin operated vending system using one or more power sources and a simple series connected selection switch.

A further object is to provide an electrically selectable coupling mechanism for a linear motion coupling.

A still further object is to provide a two-pivot escapement principle usable as a dispenser for rolling products or as a delivery box door for preventing unauthorized access to the machine.

Another object is to provide a dispensing principle using a inclined or horizontal conveyor belt for front end dispensing.

A further object is to provide a modified shuttling frame dispenser similar to my U.S. Pat. No. 3,713,562 for horizontal operation adaptable to mechanical or electrical control.

A still further object is to apply the electrically controlled coupling mechanism to drive a 120° indexing mechanism for belt-type dispensers or for one revolution feedcoil dispensers.

A summarized object of the invention is to provide a vending system with comparative simplicity, economy and compactness plus interchangeability of dispensers to obtain a maximum storage capacity in a vending cabinet containing a common mechanical or electrical control system.

The following specification and illustrations are best showing the parallelism and flexibility of adapting same dispensers to the novel electrical control or to the mechanical operation in which:

FIG. 1 is a partly fragmentary plan view of a typical shelf assembly shown with four belt dispensers and an electrical operating mechanism;

FIGS. 2 and 3 are front and side views of FIG. 1;

FIGS. 4 and 5 show an electrically driven belt dispenser;

FIG. 6 shows a partial crosssection of FIG. 1 taken along the line 6—6 for mounting the unit of FIG. 4;

Figure 26:
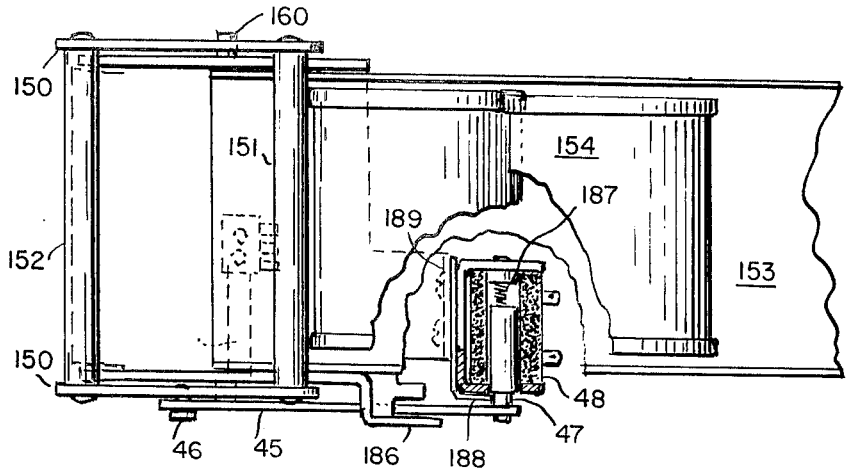
Figure 25:
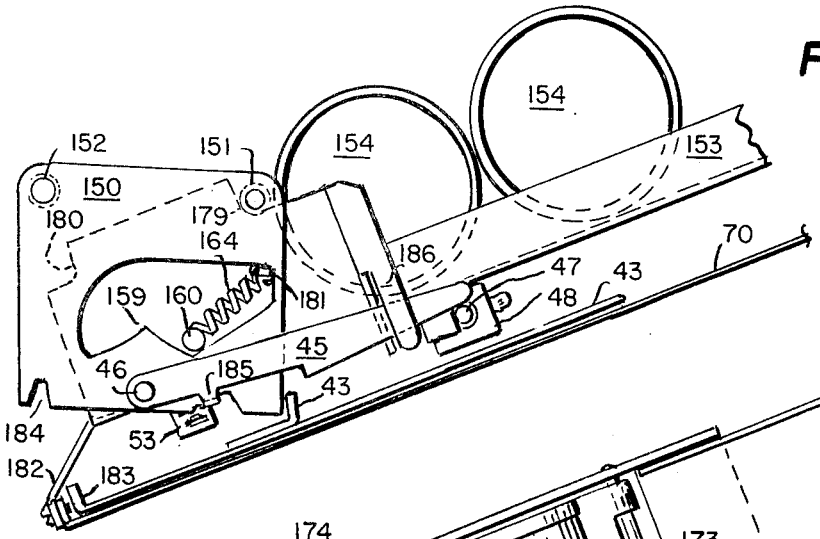
Figure 24:
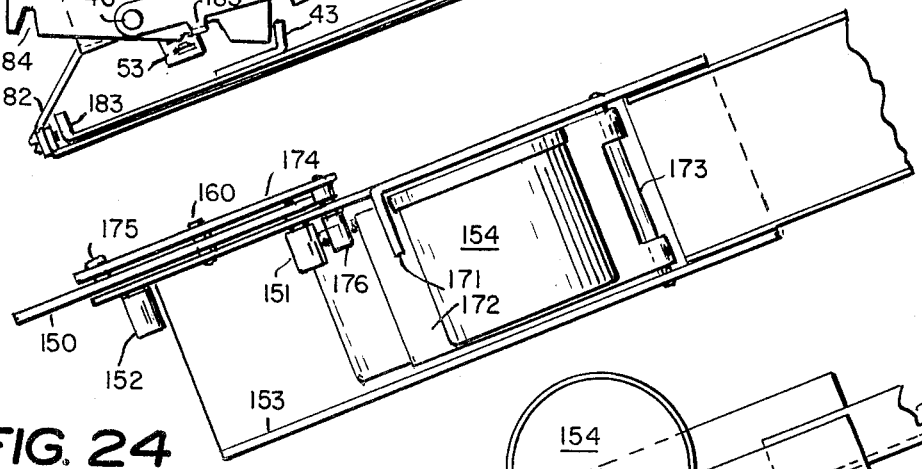
Figure 23:
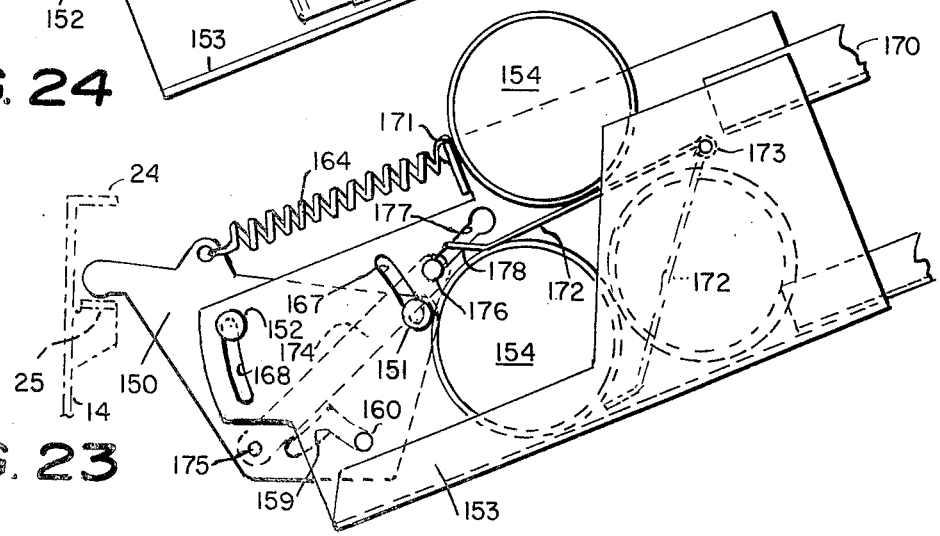
Figure 29:
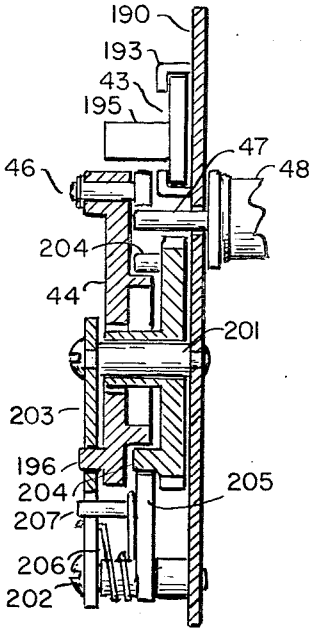
Figure 28:
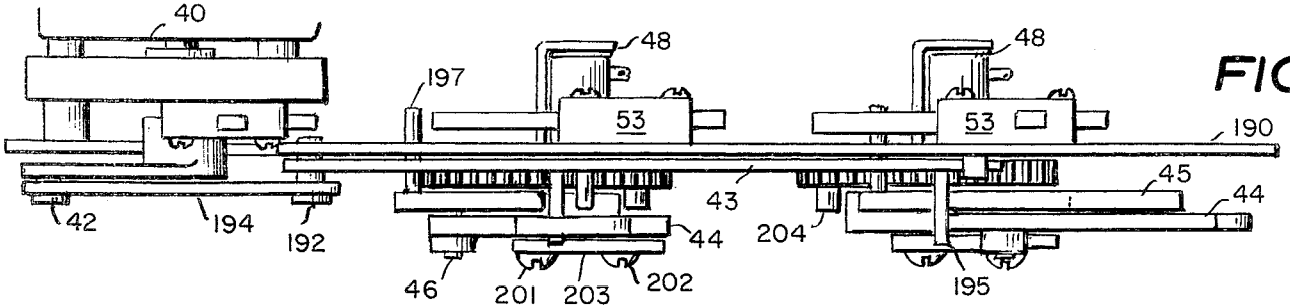
Figure 27:
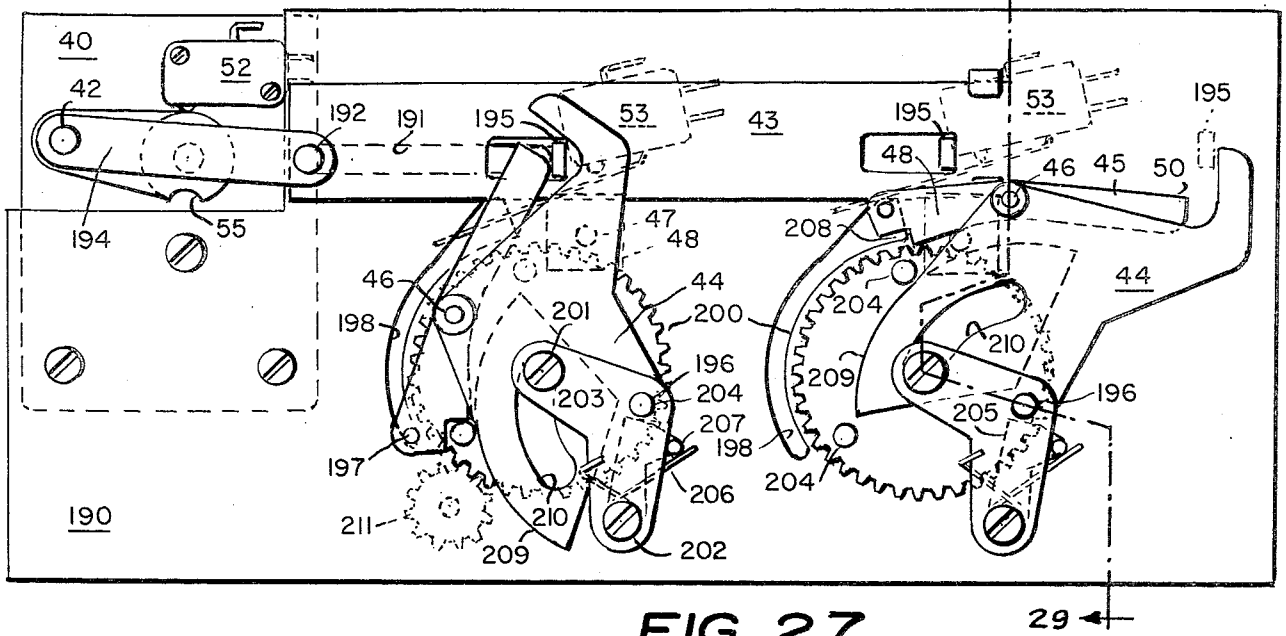

FIGS. 11-A, 11-B and 11-C illustrate the basic principle of the electrically controlled coupling mechanism in three different positions;

FIG. 12 is a schematic of the electrical control version;

FIGS. 13, 14 and 15 illustrate a shuttling frame dispenser for mechanical operation in front, side and top views;

FIGS. 16, 17 and 18 show a similar shuttling frame dispenser for electrical operation also in front, side and top views;

FIGS. 19-A, 19-B, 19-C, and 19-D show the basic two-pivot escapement principle in four successive positions;

FIGS. 20 and 21 show a solenoid operated dispenser for rolling items in front and top views;

FIG. 22 shows a schematic for the dispenser of FIG. 20;

FIGS. 23 and 24 illustrate a mechanically operated dispenser for rolling items in front and top views;

FIGS. 25 and 26 show a similar dispenser for electrical operation in front and top views;

FIGS. 27 and 28 illustrate an electrically controlled coupling mechanism for wide angle indexing in front and top views and FIG. 29 is a section of FIG. 27 taken along the line 29—29.

MECHANICAL CONTROL

Figure 7:
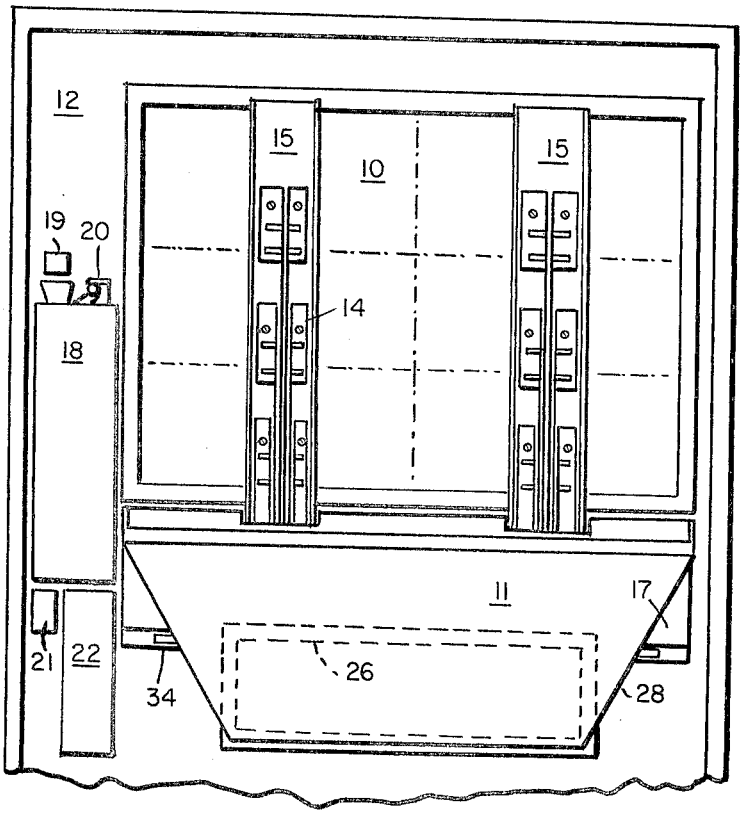
FIGS. 7 and 8 are the inside view and the side view of a cabinet door for a mechanically operated machine.
Figure 8:
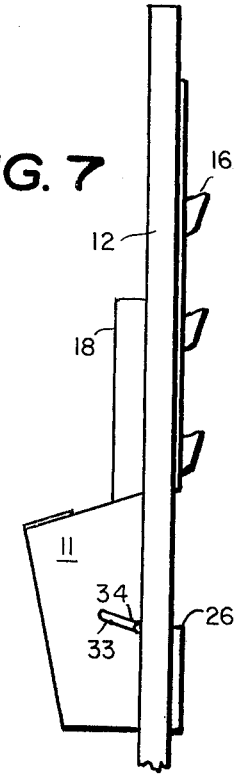

All the illustrations of the vending system refer to a preferred cabinet arrangement where a number of trays or shelves, as shown in FIG. 1, are arranged on top of each other in a way that the foremost articles in each dispenser are visible through a display window 10 as shown in FIG. 7 for a mechanical control. Since the merchandise in this cabinet arrangement is placed rather close to a delivery location, a delivery box 11 is normally used to prevent any unauthorized access to the product storage.

For mechanical machines, the vertically operated control mechanism, as fully described in my U.S. Pat. No. 3,713,562, can be conveniently mounted to the door 12 where the operating slides 14 are grouped and guided by vertical guide members 15 which have guide slots for operating knobs 16 to permit a through the door connection between slides 14 and knobs 16. the thin linkage of the operating bar and vendprice control is hidden underneath a cover 17 while the lock mechanism, changemaker, totalizer, slug rejector, escrow bucket and the resetting linkage arer underneath another cover 18 and are not shown in detail. Only the coin entrance 19, coinreturn lever 20, coin return bucket 21 and the cashbox 22 are visible as standard equipment in most vending machines.

On either side of the vertical guide members 15 are transparent window areas 10. In FIG. 7 dotted lines are used to divide this to twelve areas, each indicating the location reserved for a dispenser. The arrangement refers to a smaller machine with three product trays, each having four dispensers of any kind as they will be described later.

The motion of knobs 16, which are visually keyed to the products, is divided to a free sensing motion up to a lockpoint and to an operating motion after the lockpoint. As fully described in my above mentioned patent, the lockpoint can be passed only by one of the slides 14 after the required credit was registered by the mechanism. Providing now a lost motion coupling, equalling the sensing motion up to the lockpoint, between the slides 14 and dispenser actuators 23 means that only the motion after the lockpoint will be transmitted to the dispenser actuator 23 while in same time the resetting and other vending control functions can take place. Ears 24 and 25 is one way to provide a convenient coupling between the operating mechanism on the door and dispensers on the inside of thw machine. In this arrangement the complete control mechanism is on the door which automatically uncouples all the dispenser operating levers 23 when the door is opened. Slides 14 could be made to operate in either direction first. If they operate first down as shown in FIG. 7, a return spring has to be used to counteract the gravity (not shown).

A novel two-pivot escapement principle is applied to control the operation of a one piece delivery door in the delivery box 11 which is constructed around the delivery opening 26 having its bottom 27 acting as a delivery platform and its side plates 28 as guiding and supporting means for the door 29 and for a restricting corner 30 which can extend all the way across behind the door 29. A rear plate 31 with a bent over top portion 32 is not a functional part and could be used only as a cover and reinforcement means for the box and corner piece 30. Box 11 could have a rectangular shape but the funneled construction, as shown in FIG. 7 is possible here offering a lighter construction and easier merchandise pickup.

The door 29 is fitting freely between side plates 28 which have slots 33 for a pivot rod 34, permitting a pivoting and sliding action of the door thereby. Door 29 has a bentover portion with an edge 35 to form an upper compartment normally in an open position to permit the entrance of a dispensed merchandise 36. Another restricting corner 37, as a part of the door 29, is acting against the corner 30 to control an opereting sequence of the door 29.

Figure 9:
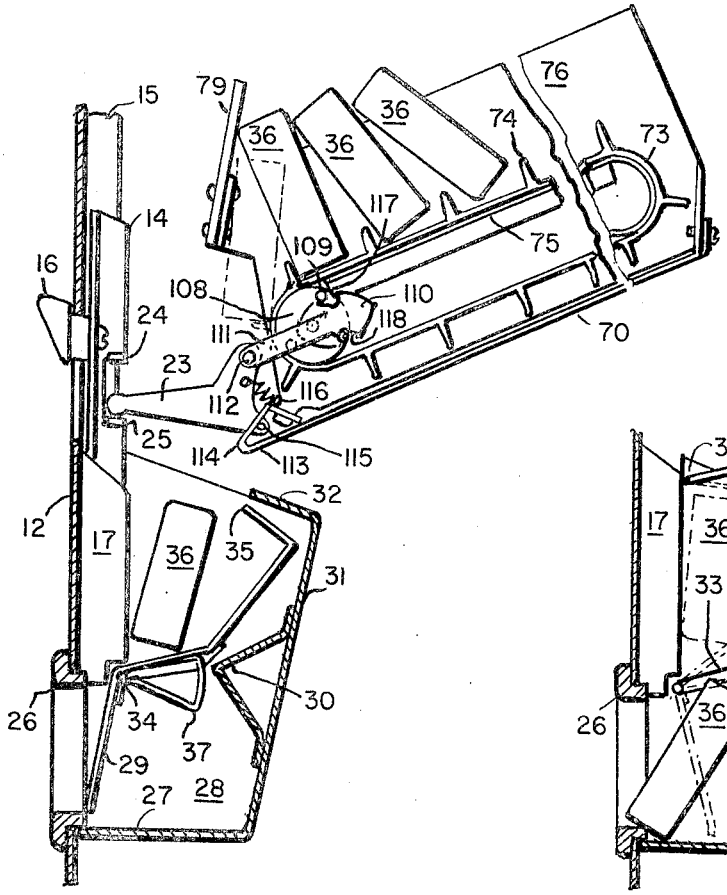
FIG. 9 shows a mechanically operated belt dispenser with a section of a delivery box and the cabinet door.
Figure 10:
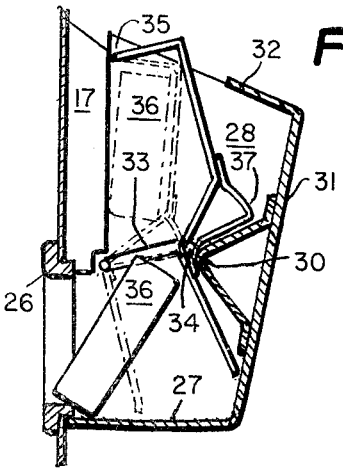
FIG. 10 is showing a section of the delivery box in a different position.

If now the door 29 is pushed in, it first is restricted to pivot in a counterclockwise direction until the restrictors 30 and 37 are clearing each other as shown in dotted lines in FIG. 10. Now the merchandise 36 is completely trapped and the access through box 11 is closed in two places. A further push of door 29 is changing the pivot from rod 34 to the edge 35 acting against the cover 17. Rod 34 can now slide in slot 33 and the restrictor 37, acting now against the top portion of restrictor 30, is maintaining a close contact of edge 35 against cover 17. The merchandise 36 can now fall to the delivery platform 27 permitting a pickup through the delivery opening 26. Gravity is sufficient to restore the normal position of door 29 as shown in FIG. 9.

The basic principle of the door motion could have various detail modifications. One of the restrictors 30 or 37 could be replaced by a long roller or two end rollers acting against a mating restricting corner same way as described before. Another way to reduce friction is adding a connecting link to each end of the door 29. Again two methods are possible here with same end result. In one case the rod 34 could be hung by these links which have their other pivot supported by side plates 28 and lining up with the edge 35 as it is shown in its midposition (dotted lines in FIG. 10). In the second case the same link has its pivot points just the opposite way: the sideplate pivot will line up and replace the rod 34 and the other pivot will be on the line of edge 35 of the door 29. In both cases this link is making the center of rod 34 to follow the curve of slot 33. A similar link connection is illustrated in FIGS. 19 and 20 and described later for a rolling product dispenser which also illustrates a possible deviation of pivot points as just described.

ELECTRICAL CONTROL

The construction of the cabinet and dispenser arrangement for an electrically operated vending machine could be quite similar to the mechanical machine as just described. The distinguishing difference here is the control and actuation of dispensing which is done by an electrical power source when a selection button is depressed. The flexibility of the electrical connection gives more design freedom to the front face of the machine which could look same as the mechanical machines with knobs 16 replaced by the buttons of selection switches or it could have a single display window for the complete dispenser group with selection buttons located somewhere close to the coin control area. In that case reference characters should be employed to key the selection buttons to the products.

Though individual motors could be used to power each dispenser, it is the object of the invention to use a single motor as a power source for all dispensers or one for a dispenser group. The one motor system requires a coupling mechanism which has to be capable of receiving a selection signal, perform a coupling action and have resetting means for restoring the standby position. It is the novel arrangement of this coupling mechanism which offers more compactness and a simpler electrical control as compared to existing coupling mechanisms of this kind.

The basic mechanism, as shown in FIG. 11, includes an electrical drive motor 40 with a cam disk 41 which is driven through a gear reduction box and which has a crankpin 42 to reciprocate an operating link or bar 43 once within each cycle of cam 41. The mechanism further includes a pivoting member or a slide 44 which is carrying a pivotally secured coupler lever 45 using a pivot stud 46. A spring or gravity operated plunger 47 of a solenoid 48 is holding an arm 49 of the coupler 45 which keeps another coupler arm 50 in a nonactive position as shown in FIG. 11-A.

The electric control circuit includes the power lines 51, a motor switch 52, a coupler switch 53 and a selection or pushbutton switch 54. The actuator of the motorswitch 52 is resting in a notch 55 of the cam 41 and the actuator of the coupler switch 53 is controlled by an arm 56 of coupler 45.

The coupling cycle can be started by the normally open selection switch 54 energizing the solenoid 48 which has a circuit passing through all three switches. The energized solenoid 48 will pull its plunger 47 away from the holding position of FIG. 11-A allowing a counterclockwise motion to coupler 45. This action will be aided by the spring biased of coupler switch 53 which will interrupt the solenoid circuit and complete the circuit to the motor 40 as shown in FIG. 11-B. Now the coupler arm 50 is engaged to operating link 43 which will be driven by the motor crankpin 42 to the right. FIG. 11-C shows the extreme right position after a 180° rotation of crankpin 42. In this position the solenoid plunger 47 is cleared by arm 49 which lets its return spring (could be a small compression spring inside the plunger as shown in FIG. 26) to restore its original position.

During the return stroke the link 43 is contacting the slide 44 and pulling it back to the standby position as shown in FIG. 11-A. This means that the solenoid plunger 47 will act now like a stationary pin acting against a moving camsurface 49 of coupler 45 which is causing an easy resetting throughout the return stroke of link 43. Before the motor switch 52 can drop into the homing notch 55, the coupler switch 53 is already in its standby position preventing the restart of the cycle which can be initiated again only by the pushbutton 54.

This basic three dimensional mechanism has distinctive advantages over the existing ones making it suitable for a large variety of selective coupling applications. Its stationary coils eliminate flexing cables and enable the use of a very compact and simple operating linkage. Its easy resetting throughout a half cycle and stopping at dead end position remove the critical element from the mechanism as compared to the ones which have to be overdriven for resetting and the inclusion of the coupler switch 53 gives an instantaneous response to the pushbutton 54 which will be one of the selection switches.

The most demanding application of the mechanism is in coin controlled vending machines requiring a circuit logic for a tamperproof operation. In FIG. 12 a basic control is shown to illustrate a unitized arrangement with a minimum number of circuit components. Shaded areas are used to better point the typical groupings of switches in the circuit chain. The schematic includes a series connected selection switch unit containing the switches 54 which require no other mechanical interlocking as found in many similar selection units. Next in line are two operating units each having the electric motor 40 with its cycle switch 52 and any number (only two are shown) of dispenser coupling units, each including the electrical actuator or solenoid 48 with its coupling switch 53. The powerline 51 is connected to one side of the motors 40 and solenoids 48 while the other side goes to the common of one of the motor switches 52, same as shown in FIG. 11. The switch chain is normally broken by the contacts 58 of a relay 59 which prevents energization of any of the solenoids 48 by switches 54. A pulse from a coin switch 60, which could be a direct pulse from a falling coin or the output of a totalizer, can energize the coil of the relay 59 whose contacts 58 form a holding circuit for the coil through motor switches 52. The holding circuit also connects all the coupler and selection switches 52 and 54 to the left power line. The energization or selection of one of the solenoids is now possible. If this is unit No. 1 for instance, the coupler switch 53 of the selected dispenser will close the motor circuit and gets the motor in unit No. 1 started. Then the motor switch 52 will connect the motor directly to the left power line and by doing that, the holding circuit of the relay 59 will be broken which will reset it and cut the rest of the circuitry off. The motor 40 in unit No. 1 can now run through its cycle as explained for FIG. 11, but the next selection cannot be made without receiving a new pulse from the coinswitch 60. The relay contacts 58 and motor switches 52 are also keeping a coin return electromagnetic 61 energized in standby position permitting a coin entrance, while any of the switches 52 and 58 can deenergize the magnet 61 which prevents a coin acceptance as a customer safety.

The basic control circuit has flexibility for modifying it for different requirements. A manual credit switch 62 and a delivery switch 63 are shown in dotted lines and a multiprice circuit is shown on the right side. The credit switch 62 has same function as coin switch 60, permitting a relay energization without using a coin. The delivery switch 63 is required in some systems having no other way to signal an empty condition. It is a parallel circuit to the motor switches 52 and it will be opened only by a delivered product. This means that the credit hold by relay contacts will be maintained and the customer can make another selection until the switch 63 opens together with one of the motor switches 52 to break the relay hold and cancel the credit thereby.

The use of a price board and a totalizer circuit, as shown on the right side of the basic circuit, is a standard practice in vending industry having many different detail variations and therefore it will be only briefly described here. The price board 64 is a switching matrix where the vertical lines are representing increasing coin values in 5 cent increments. The totalizer 65 basically is a stepper switch normally in a zero position. The vend solenoids 48 in this circuitry are connected through this price board 64 and totalizer 65 to the right power line. The upper solenoids in units No. 1 and No. 2 are shown to be connected to the 15 cent line which means that only when the totalizer wiper has been stepped to make contact with the 15 cent line, can one of these solenoids be energized. Since the totalizer is always returned to zero position during a vend cycle, the relay 59 is not necessary in this circuit.

Another circuit modification is possible for some light acting dispenser mechanisms where a direct solenoid operation could be used. The circuit in FIG. 22, as described later, could act as an independent circuit or part of the circuit in FIG. 12.

INDEXABLE BELT DISPENSERS

All the dispensers of the invention can be mounted to a horizontal or slightly inclined dispenser tray 70 (FIG. 1) which could have its side plates 71 formed in any suitable way to provide a convenient sliding mount in the cabinet for loading or servicing purposes. The tray 70 could have a corner cut 72 to provide a clearance for the coin control or selection buttons which are normally mounted to the right side of the door. A dispensing tray can have any number of dispenser modules removably or permenently mounted to it. The front end of the tray 70 is placed close to the display window with the foremost articles of all dispenser modules in a display and dispensing location from where a dispenser actuation can release a selected article which will be followed by a drop to the delivery platform 27 for pickup as explained before.

To provide a product release from a horizontal or inclined storage tray, a forced or a transporting feed is used with a dispensing mechanism acting to provide the product release. Gravity or spring loading is suitable to provide a forced feed and the dispensing will act then as a one-by-one release mechanism which has some similarity to escapement mechanisms as described later for shuttling frame and rolling product dispensers. In transporting feed dispensers each product will be advanced individually which maakes it suitable for non-uniform shapes like soft containers or bagged products.

The known transporting feeds are a feedcoil dispenser, where each revolution of the coil is advancing the products and releasing the foremost one, and a vertical belt dispenser where the products are placed on the horizontal belt carried platforms individually and the dispensing is done near the bottom curve of the belt. In this transporting feed category the invention is providing a horizontal belt dispenser with a mechanically or electrically operated indexing drive and a method to apply the basic coupling mechanism of FIG. 11 to obtain a one revolution control suitable for feedcoil dispensers.

Basically, the belt dispenser as shown in FIGS. 4, 5 and 9 works like a small scale indexable partitioned conveyor with the front end dispensing. Belt 73 with partitions 74 can be manufactured from any elastic material as a molded part or it can be assembled from links or the partitions 74 could be secured to a flat endless belt in any convenient way. A direct indexing, as shown for electrical drives in FIG. 4 or a sprocket indexing, as shown in FIG. 9 for mechanical machines, could be used to advance the belt 73 incrementally one pitch (the space between partitions 74) at a time. The direct feed is acceptable for horizontal belts but for inclined or for vertical belts an unevenly loaded belt can run down and therefore a positive indexing and sprocket drive is more suitable.

The supporting framework for a module, which can have many variations, is made to suit the drive method, the method of mounting the individual dispensers to the product tray 70 and the pitch of the belt which in turn is determined by the product size. FIGS. 4 and 5 show a dispenser module for a direct indexing where the coupling lever 45 is also serving as the drive pawl for the belt 73. The latter is supported by a platform 75 which has one side of it bent up to act as a partition 76. This means that the left side of the tray 70 and the L-shape dispenser modules placed next to each other are forming U-shape compartments for full product guidance as shown in FIG. 1. The ends of the platform 75 can be rounded or rollers can be used on each end for belt guiding purposes. In FIG. 4 the rear end of a platform 75 is rounded at 77 having any suitable radius while the front end has a roller 78 whose diameter equals approximately the pitch of the belt 73.

This pitch and diameter proportion means that the foremost upright partition 74 will be advancing about 30° below the horizontal line when the belt 73 is indexed. Consequently, a product, placed between the first and second partition 74, will be moved forward and released over the front end during an indexing motion. Partitions 74 can have different heights and spacing. Smaller items can be placed just between partitions 74 but for thin items the best storage density can be obtained by placing them upright, the foremost one leaning against a barrier plate 79 and the next ones leaning against each other as shown in FIG. 9. A single transparent barrier plate 79 could be fastened to the left side of the tray 70 and to a bracket 80 on the right side (FIG. 1) or each dispenser module could have its own barrier plate suited to the merchandise it is dispensing. The belt indexing again moves the foremost product to a position permitting its fall and placement of the next one to the display position, leaning against the barrier plate 79.

Platform 75 is supported by a bracket 81 which could be a one piece sheetmetal part shaped to act as a means of supporting all the components and mounting the module to the tray 70. Bracket 81 could be welded to platform 75 and its bentover side plate 82 together with an ear 83 are supporting rotatably the front end roller 78. The solenoid 48 could have its coil frame also formed from the stock of bracket 81 which is extending still further to form a U-shape guiding and supporting section 69 for the belt 73. The platform 75 is wider than the belt 73 leaving a space between sideplate 82 and belt 73 to clear the coupler switch 53 and the coupler slide 44 together with the coupler lever 45 which have their pivot stud 46 working in a guide slot 84 of sideplate 82. Another guideslot 85 is provided for a bentover portion 86 of slide 44 to prevent the rotation of it. Ear 86 is also having a guide slot for an arm 87 of coupler 45 for better lateral stability. A spring 88, hooked between the coupler 45 and ear 86 and the spring biased actuator 89 of switch 53 acting against an ear 90, are both providing a clockwise spring bias to the coupler 45 which is held by the plunger 47 of solenoid 48. Coupler 45 also has a wide drive pawl 91 which can come into engagement with one of the partitions 74 when the plunger 47 is pulled in.

Sideplate 82 has two tabs 92 and 93 engageable to mating slots 94 and 95 in a plate 96 which mounts the complete drive mechanism as shown in FIGS. 1 and 6. The operating bar 43 of FIG. 11 here is a flat parallel motion bar with a bentover end 97 extending all the way across between the bottom of tray 70 and mounting plate 96 which has clearance holes 98 to permit a coupling connection between the operating bar 43 and the coupler 45 of any dispenser module on top of it.

The front end of plate 96 could be formed in any convenient way to suit the dispensers and provide an angular surface for product guidance and price and reference tags 99. Plate 96 has two pivot and guide studs 100 for bellcranks 101 and operating bar 43 which has guideslots 102 for studs 100. One arm of bellcranks 101 has a stud and slot connection 103 and the other arms of it are pivotally joined by a connecting link 104. Another connecting link 105 is used between the crankpin 42 and connecting link 104 or one of the bellcranks 101 to transmit the cycle of cam 41 to a reciprocating motion of the operating bar 43. Thus the complete parallel motion linkage is very compactly fitted between plates 70 and 96 which has the coupling slots 98 and locating slots 94 placed to suit the dispenser arrangement on top of it. (FIGS. 4 and 6).

If now one of the selection buttons 54 is despressed, the elactrical and mechanical control sequence will be followed through as explained before for FIGS. 11 and 12. This will unlatch the coupler 45 letting the spring 88 to move it to the position as shown in dotted lines in FIG. 4. Now the operating bar can transmit its motion to pawl 91 which in turn will advance the belt 73 one pitch length to accomplish a dispensing over the front end. The return stroke of bar 43 will reset the mechanism which cannot be coupled and started again without the energization of solenoid 48.

Connectors 106 could be used to permit the removal of the dispenser trays from the cabinet and in same way the solenoid 48 and switch 53 of each module could be connected through a connector to the circuit of the dispenser tray for eacy interchangeability.

The dispenser module of FIG. 4 could have a mechanical direct ratcheting drive where the drive pawl 91 will be linked to one of the operating slides 14. FIG. 9, however, shows a sprocket drive method which is more suitable for inclined dispensers or is required for vertical belt drives where the uneven belt loading can make them run down without a positive indexing drive.

The overall structure of the dispenser tray 70 could be very similar to the one shown in FIG. 1 including the barrier plate 79, partitions 76 and the platform 75 for belt 73, but the front end roller is acting here as a sprocket wheel 108 having any suitable positive drive connection with belt 73 as they are widely known in industry (not shown).

Though various indexing methods could be used to drive the sprocket wheel 108, a positive wide angle indexing drive, as fully described in my pat. applic. Ser. No. 583,182, filed June 2, 1975, is most suitable to satisfy all the requirements of this dispenser drive. Its basic elements are three driven pins 109 as part of the sprocket wheel 108 and a driver 110 carrying a connecting link 111 with a pivoting connection at 112 to the operating lever 23 which in turn has its pivot 113 guided by a slot in a bentover front end 114 of tray 70 and by a rod 115 which can serve as a pivot rod for a series of levers 23. A tension spring 116 is keeping the lever 23 in its standby position while the ears 24 and 25 are providing the lost motion coupling as explained before. The shape of driver 110 is preventing the escapement or rundown of sprocket wheel 108 and the two drive notches 117 and 118 are acting alternately to advance the sprocket wheel 108 60° per a downward stroke of slide 14 and another 60° during the return stroke of slide and lever 23 as fully explained in my above mentioned patent. Sprocket wheel 108 could have a backup pawl (not shown) through the inclined belt normally is sufficient to prevent any backward motion.

This wide angle two step indexing is very suitable for mechanical drives where the downward stroke of lever 23 is placing the product 36 in a half-way position, as shown in dotted lines in FIG. 9, and the release of it is done during the return stroke which is placing the holding partition 74 from an upright position to a downward position.

The 120° sprocket type indexing is also very suitable for an electrical operation where the 120° indexing can be best accomplished during one stroke as will be described later for a coupling method of indexing drives.

SHUTTLING FRAME DISPENSER

The basic shuttling frame dispensing principle as claimed in my U.S. Pat. No. 3,713,562 for a vertical storage column, could be modified for a horizontal storage which is suitable to fit the framework of the front end display and dispensing. The difference here is that instead of a vertical gravity feed, a horizontal forced feed is used and the fully closed shuttling frame is modified to a U-shape frame with its bottom open. FIGS. 13, 14 and 15 show a wider frame 120 with a pivot point 121 suitable for uniform width containers such as cigarette packages and FIGS. 16, 17 and 18 show a frame 122 with a pivot point 123 for containers having a larger height to width proportion. The merchandise for this frame can vary in height, thickness and shape which makes it suitable for round or rectangular gum and mint packages as they are widely known in vending industry. Both of these slightly different dispensers can be operated again mechanically or electrically and just for illustrative purposes the cigarette dispenser (FIG. 13) is adapted to a mechanical operation and the gum and mint dispenser (FIG. 16) is shown electrically operated.

The storage structure and method of providing the required forced feed is same in both cases and therefore same reference numerals are used for parts having same function. An L-shape chute structure, as in belt dispensers, is also used here to provide a horizontal storage surface 124 and vertical partitions 125 which in these dispensers have a double wall to provide a working space for the shuttling frames 120 or 122. The partitions are mounted to a bottom plate 126 which can be directly the bottom of the tray 70 as shown in FIG. 1 or a separate base plate for a smaller gum and mint module for instance. Plate 126 has a bentover front end 127 providing a sloping surface for the falling merchandise and price tags. A space is left between the storing surface 124 and partition 125 which is best shown in FIG. 18. This provides a working clearance for a U-shape guide section 128 of a pusher plate 129 which is spring loaded toward the right using a constant force spring 130, known under a trade name "Negator" in the industry. One end of the spring 130 is fastened to the pusher 129 using a lancing and crimping method or any other suitable means and the other end of it is rolled around a pulley 131 which is rotating freely on a stud 132.

Moving the pusher 129 to the left (FIG. 14) means unrolling the spring 130 from pulley 131 and storing a spring energy which can move the pusher 129 to the right with a constant spring force providing a forced horizontal feed to the merchandise packages thereby. The first package 133 in FIG. 14 will be forced then against two sections 134 and 135 of the shuttling frame 120 which keeps the packages away about one third of their thickness from a front plate 136. The latter is tied to the bentover portions 137 and 138 of partitions 125 by means of spacers 139 which are serving as pivot studs for frames 120 and 122 and spacing and alignment means for the front plate 136 and partitions 125. All these openings: the chute, formed by partitions 125, the opening in frame 120 and the opening in front plate 136 are same size with a small side clearance for the packages 122. The openings can be designed for the largest merchandise size permitting the use of smaller ones without any change. One of the limit positions of the pivoting or shuttling frames 120 or 122 is designed to line up with the merchandise storage chute and the other one with the opening in plate 136 which leads to a similar arrangement as described in my above mentioned patent.

In mechanical machines it is desirable to provide the merchandise delivery during return stroke of the operating knob 16. A direct coupling of a tab 140, requiring an extra clearance 141 in front plate 136, can be used here to couple the frame 120 to the ears 24 and 25 of the slide 14 (FIG. 9). The downward motion of a slide will then pivot the frame 120 in a counterclockwise direction until it is lined up with the chute which lets the foremost package 133 be pushed against the plate 136. During return stroke the frame 120 will pivot in a clockwise direction together with the package until it will be lined up with the angular opening in plate 136. Now the spring 130 can push the package 133 further foreward so it will be well cleared by a cut 142 in the bottom plate 125 and a free fall of it to the delivery box 11 can follow.

Same dispensing principle is adaptable for electrical operation as shown in FIGS. 16, 17 and 18, using a similar framework as just described. Here the pivot point 123 of frame 122 is about on top level of merchandise which makes the dispenser suitable for long rectangular and round merchandise shapes. The coupling mechanism employs the same basic componenets of FIG. 11 having same reference numerals and same coupling action despite a different look.

The mechanism is fitted partly between the partitions 125 and partly underneath the merchandise storage, offering a very compact and neatly covered arrangement. It includes again the solenoid 48 with its plunger 47 holding the coupler 45 and the operating bar 43 working underneath a group of dispenser units. The slide 44 in this version is a pivoting member with its pivot point at 142 and acting as a bellcrank for transmitting the motion of the operating bar 43 to the frame 122 by means of a right angle connection where an arm of member 44 with a rounded end 143 is extending through a guideslot in section 138 to make a connection with a socket 144 of frame 122. A lancing 145 could be used for better lateral stability of member 44.

In an electrical machine, where the operator has no control to the dispensing motions, the frame 122 can be in alignment with the chute in a standby position. This means that the merchandise will be already against the plate 136 and a fast dispensing will take place during the first half of the cycle. The operating sequence is again initiated by the energized solenoid which lets the coupler 45 move to a coupled position while the electrical action of switch 53 will disable all the other selector switches 54 and start the motor. Now the motion of bar 43 to the right (FIG. 17) will be transmitted to a clockwise motion of frame 122 which is surrounding the foremost merchandise 133 (FIG. 16). On the end of this pivoting motion the merchandise will clear the angular opening in plate 136 allowing the pusher 129 to push it foreward. Now it will also clear a notch 142 (FIG. 18) permitting a free fall to the delivery place. The return stroke of bar 43 will line up the frame 122 with the storage chute allowing the entrance of next merchandise. On the end of the half cycle the plunger 47 will clear again the cam surface 146 of coupler 45 letting the plunger 47 to act as a resetting pin for the moving coupler 45 as described before.

The dispenser modules could be arranged or grouped in many different ways. FIG. 16 shows two of them next to each other with a common front plate 136 which could be made from a transparent material for full visibility to merchandise and with covered areas 148 for styling purposes.

DISPENSER FOR ROLLING PRODUCTS

An inclined plane with rolling products takes advantage of gravity to get a forced feed and the dispenser can then be an escapement type mechanism for positively releasing the products one by one. A turnstile-like dispenser with a 120° indexing control, as described in my pat. applic. Ser. No. 583,182, filed June 2, 1975, can act as a mechanically or electrically operated positive dispenser but in this invention the same two-pivot escapement principle of delivery box 11 (FIGS. 9 and 10) can also act as a positive dispensing mechanism for cylindrical shape products. As compared with the widely known single pivot escapement levers, the two-pivot arrangement offers a positive release sequence for products, eliminating the possibility of overriding which can be the case if an attempt is made to use a single pivot escapement lever.

Three different applications of the same basic principle will be described which are illustrating the most typical arrangements only. The key part in the mechanism is an escapement lever 150 which has its two pivot points 151 and 152 on a line parallel to the inclined plane 153 and spaced apart slightly less than the diameter of cans 154. This is shown best in FIG. 19-B which is a midposition from where the lever 150 can pivot to either direction to reach positions A or C of FIG. 19. Few different methods with the same end result are available again to restrict the pivot points 151 and 152 to make them act one at a time.

In FIGS. 20 and 21 a connecting link 155 is shown as a U- and L-shape wire from having a pivot point 156 provided by two ears of chute 153 which further includes guiding side plates and a bentover portion 157 to provide a positive hold to cans 154. Escapement lever 150 is shown as a U-shape sheetmetal part with a rolled over end to provide the pivot 151 around the wire link 155 which is extending through an opening 158 in chute 153. Lever 150 has a bentover side with a restricting corner 159 acting against a stud 160 which is secured to a lanced ear 161 of chute 153. The latter serves also as a mounting base for an operating solenoid 162, for a resetting switch 163 and for a spring 164 which is hooked to the lever 150 for keeping it in its standby position as shown in FIGS. 20 and 19-A. A wire link 165 is shown as a connecting means between the solenoid plunger 166 and lever 150.

The four positions in FIG. 19 are illustrating the dispensing sequence where in standby position A the can 154 is held by pivot point 151 whose downward movement is restricted by corner 159 against stud 160. This restriction is dictating that the midposition, where both points 151 and 152 are up (positions B and D), has to be reached before one or the other points 151 or 152 can move down and release a product. If now the solenoid or any other operating stroke toward the front is applied to point 169, first the midposition B is reached and then the point 151 can swing down to position C which lets the cans 154 roll down until they are stopped by point 152.

During return stroke of actuating point 169 the same sequence will be followed through in the opposite direction where the standby position A cannot be reached without going through the position D. This means that the foremost can 154 cannot be released before point 151 is positively in a position to stop the next can.

The restricting corner 159 is formed by two arcs whose centers are pivot points 151 and 156 as taken from the midposition of lever 150. This demonstrates a possible offsetting of points 152 and 156 which in this case means that in position C the rolling force of cans 154 is added to the force of spring 164 during return stroke. In case points 152 and 156 are made to coincide, the force of rolling cans cannot affect the motion of lever 150. If this arrangement is selected, a second connecting link, applied similarly to link 155 with a pivot at 152, can provide the required restriction without corner 159 and stud 160.

The dispenser mechanism is operable mechanically when an extra arm is added to lever 150 similarly to FIG. 23, or electrically through the coupling mechanism of FIG. 11 when link 165 is connected to operating slide 44, but since the required operating power is rather low, a direct solenoid operation is possible with a slightly simplified control circuit. The circuit in FIG. 22 is using same control logic as the one in FIG. 12 including the powerline 51, selector switches 54, coin switch 60, relay coil 59 with its contacts 58 and the coin return electro-magnet 61. There will be no drive motors because the solenoids 162 will actuate the dispensing mechanism directly when one of the selector buttons 54 is depressed after relay contacts 58 were switched over the hold position as described before. The series connected motor switches 52 of FIG. 12 are replaced now by resetting switches 163 whose purpose is also to break the relay holding circuit which in turn will open the contacts 58 and restore the standby position of the circuit.

Switches 163 can be operated in many different ways. FIG. 20 shows them operable by cans 154 which can open their contact as soon they start to roll. This puts them to same category as the product delivery switches 63 in FIG. 12. The circuit of FIG. 22 can also function as one of the units in FIG. 12 including only the solenoids 162 and resetting switches 163 in series with the motor switches 52. There will be then a common relay and the selector switches 52 will be added to the selector unit.

FIGS. 23 and 24 show a manually operated dispenser where the pivot points 151 and 152 of escapement lever 150 are shoulder studs guided freely by slots 167 and 168 in the U-shape chute 153 which also mounts the stud 160 for the restricting corner 159. This is an entirely different looking arrangement of the same basic principle where the pivot studs 151 and 152 are working above the centerline of cans 154 and the escapement lever 150 has a lateral support held together by shoulder studs 151 and 152.

The downward motion of the operating slide 14 will again first have the lost motion and then the ear 24 will start to pivot the lever 150 about point 151 until stud 152 will reach the end of slot 168 in midposition. From then on, stud 152 will act as a fulcrum causing stud 151 to raise until can 154 is free to roll against stud 152. During return stroke, which will be aided by the spring 164, the second half of the dispensing sequence takes place as explained before.

The single layer storage on chute 153 can be built upwards using various guiding methods to feed all the cans to the dispensing location from a storage area which can be constructed to meet the requirements of each particular application. In FIGS. 23 and 24 a parallel chute arrangement is shown including an upper chute 170, front stop 171 and a platform 172 pivoting on a rod 173 which is supported by the sideplates of chute 153. Platform 172 can swing down (dotted lines) to let the cans from upper layer roll down to the same dispensing location where stud 151 will hold them. If both layers are loaded, the platform 172 is resting on top of the can in dispensing location and the foremost can in the upper layer is resting on the platform 172 and against the stop 171. To permit an unobstructed dispensing from the lower layer, an extra linkage is used to lift up the platform 172 slightly to remove the holding friction of platform 172 and permit the entrance of next can to dispensing location. This lifting can be accomplished best by a link 174 which has one end pivotally secured to lever 150 at 175 and the other end of it will have a shoulder stud 176 working in a guide slot 177. In its standby position stud 176 will clear a slightly bentover end 178 of platform 172 but during the downward stroke of slide 14 when the stud 151 starts to move up, the stud 176 will start to move to the right in its guide slot 177 which is causing a slight lifting action to platform 172. If now the last can was dispensed from the lower chute, the platform 172 can swing down as soon stud 176 will clear it during return stroke and the result is a switch of feed from lower chute to the upper one.

FIGS. 25 and 26 are illustrating the application of the basic coupling mechanism of FIG. 11 to provide an electrically controlled operating stroke to actuate the two-pivot escapement lever 150 which is shown again in a slightly modified version. The escapement lever 150 in FIG. 25 is operating exactly same way as the one in FIG. 23 but it is shaped differently to provide the pivotpoint 46 for the coupler 45 on one side of chute 153 while a similar plate 150 is used on the other side without coupler 45. These plates, acting as escapement levers 150, are joined by two tie rods functioning again as pivot points 151 and 152. Thus the acting pivot points 151 and 152 are a part of the dispensing frame which is surrounding the sideplates of chute 153 and which is provided by guiding on both sides similarly to FIG. 23 despite quite a different look.

In FIGS. 25 and 26 the stud 160 and corner 159 are providing the required restriction on both sides and the slots 167 and 168 are replaced by corner notches 179 and 180 because the corner 159 and stud 160 can provide a sufficient retaining for the dispenser frame. Stud 160 is used also as one of the hooking points for the return spring 164 which has its other end hooked to an ear 181 of lever 150.

The inclined plane or chute 153 can be manufactured in many different ways. Two welded sections are shown in FIGS. 25 and 26 where the front section can serve as the mounting base for the dispenser lever 150, for solenoid 48 and for the coupler switch 53. A formed front end 182 of chute 153 is secured to the base plate or tray 70 which can also serve as mounting and guiding plate to the operating bar 43 which will be reciprocated by motor 40 as described before. A connecting link could be used to connect the escapement lever 150 to the operating slide 44 of FIG. 11, but a direct coupling and drive connection of the two-pivot lever 150 will be described where a second drive edge 183 of operating bar 43 and a mating notch 184 of lever 150 is used.

The coupling mechanism has again the basic arrangement where the slide 44 of FIG. 11 can be considered as a pivoting member with its pivot at 151. This is similar to FIG. 17 with the exception that solenoid 48 and coupler switch 53 are shown in a reversed location. This coupling connection works up to the midpoint of lever 150 and from then on the second connection between notch 184 and operating edge 183 will be in full engagement to provide a coupling past midpoint when point 151 will raise and point 152 will act as a pivot point as explained before.

The shape of coupler 45 and various details of mounting and guiding can vary again. A bentover lug 185 of coupler 45 is used to operate the switch 53 which is shown as an open blade switch mounted at right angles to the operating stroke. A guiding slot is provided for coupler 45 by a bentover portion 186 of chute 153. The solenoid 48 shows a small compression spring 187 hidden inside its plunger 47 which has a shoulder to work against an L-shape retainer 188 which is held between a mounting bracket 189 and the frame of solenoid 48. This structure of solenoid could be used in all versions of the invention and is not shown anywhere else.

The different features of the three illustrated modifications could be applied in any combination and will be influenced only by the requirements of each application. They all can be mechanically or electrically operated. The direct solenoid operation of FIG. 20 is possible for all of them but a motor driven unit is normally preferred because its smoother action and absence of impact. The single lever construction of FIG. 23 is the simplest one and is very suitable for smaller product sizes. The frame type dispenser of FIG. 25 can handle long cylindrical shapes including bottles and the version of FIG. 20 permits the closest horizontal arrangement of storage columns.

ONE PLANE COUPLER AND INDEXING DRIVE

FIGS. 27 and 28 show a one plane coupling arrangement which looks closest to the basic mechanism of FIG. 11. Here the operating bar 43 is a slide which has a straightline guidance on a mounting plate 190 provided by a slot 191 for a guidestud 192 and by two lanced ears 193. Stud 192 can also act as one of the pivot points for a connecting link 194 which is transmitting the rotation of the crankpin 42 to a reciprocating motion of operating slide 43. Switch 52 is secured to motor gearbox which is mounted to plate 190 and the homing notch 55 is providing the one revolution control as explained before.

In three previous applications of the coupling mechanism the operating bar 43 had a parallel motion and the slides or pivoting members 44 were in a superimposed arrangement. In FIG. 27 the operating member is a simple slide with lanced ears 195 acting as coupling points to pivoting members 44 which have their pivotal mounts 196 placed next to each other and which provide the pivot-point 46 to the coupler 45. The solenoid 48 and coupler switch 53 are both mounted to the rear of plate 190 permitting a convenient electrical connection of them. The solenoid plunger 47 is extending through plate 190 to control the coupler 45 as shown best in FIG. 29 and the coupler 45 is provided with a pin 197 extending through an arced slot 198 for controlling the actuator of coupler switch 53. This is again the basic multiple coupling mechannism where the pivoting member 44 can be used to actuate various dispensing mechanisms. In one application the pivoting member 44 and the shuttling frame of FIG. 13 or 16 could be combined to one part offering a simple drive mechanism suitable especially for vertical merchandise columns. Indexing and ratcheting drives is another area where the oscillating lever 44 can actuate various drive mechanisms.

FIG. 27 is illustrating an indexing mechanism where the 60° oscillation of lever 44 will be transmitted to a 120° positive indexing motion of a wheel 200. This new drive is based on one of the indexing methods as fully described in my Pat. Applic. Ser. No. 583,182, filed June 2, 1975. The mechanism includes the wheel 200 rotatably mounted to a stud 201 which together with another stud 202 are supporting a bridgeplate 203 for providing the pivot point to lever 44. Wheel 200 has three driven pins 204 equally spaced and concentric to center 201 whose location is providing a lineup of one of the pins 204 with pivotpoint 196. This is the standby position where a lockpawl 205 prevents a clockwise motion to wheel 200. The pawl 205 is pivoting on the stud 202 and is provided with a torsion spring 206 acting against a stoppin 207. The coupler 45 in this application has a double function similar to FIG. 4 where its coupler arm 50 is providing the connection to ear 195 and its other arm has a driving notch 208 for making a ratchet pawl engagement to one of the pins 204.

The arrangement described sofar can function as an ordinary ratchet drive where the coupler 45 can be used to drive a ratchet wheel with any number of teeth. In FIG. 27, however, the lever 44 has a 120° segment 209 added to it to provide a positive motion translation between lever 44 and wheel 200. Segment 209 has an opening 210 to clear the stud 201 and its size is determined by the three pins 204 which cannot rotate without the motion of segment 209 during drive stroke and which are keeping the wheel 200 locked throughout the return stroke. The proportions of the mechanism are selected in a way that the coupler arm 50 in its coupled position will trace a line close to a straigh line to permit a low friction motion transmission by ear 195 to arm 50. The motion transmission linkage itself can be viewed as a four-bar linkage where the distance between centers 196 and 201 will act as a base link and the three moving links are the lever arm 196-46, coupler 45 and the pincircle radius of wheel 200.

The mechanism in FIG. 27 can be pictured now in its standby position where the actuator of motor switch 52 is in notch 55 and both drive mechanisms are kept in their home position by ears 195 (dotted lines) as shown for the drive mechanism on the right. Then the familiar operating sequence can be initiated by one of the solenoids 48 which will release the coupler 45 to an engaged position with one of the pins 204 and with ear 195. The spring biased actuator of coupler switch 53 is sufficient to power this coupling motion and in same time start the motor 40. During the first 180° rotation of crankpin 42 the lever 44 will be pivoted 60° while in same time the coupler 45 will give a 120° advancement to the wheel 200. Now the position on left side of FIG. 27 is reached where pawl 205 picked up next pin 204 to prevent the backward motion of wheel 200. During this half cycle the solenoid plunger 47 is clearing the coupler 45 permitting its resetting during the return stroke of lever 44 as described before.

The 120° positive indexing motion of wheel 200 is useable in many different ways. It is suitable for driving the sprocket wheels of vertically arranged dispensing belts with storage platforms or for advancing inclined dispensing belts as shown in FIG. 9. Its 102° indexing increment can be geared up or down to get any other indexing angle. In FIG. 27 wheel 200 is provided with gearteeth which can drive a smaller gear 211 as shown in dotted lines on left mechanism. If this speedup ratio is 3 to 1, for instance, a full revolution control is obtained which is suitable to rotate feedcoil dispensers as they are widely used in vending industry.

SUMMARY

The common element of all the dispensers in this invention is a method of dispensing over the front end of the dispenser tray using different dispensing mechanisms whose common element again is a light power operating lever. These common factors make the system suitable for a mechanical control as described in my U.S. Pat. No. 3,713,562 or for the new electrical control system where the common element is the coupling method for connecting a selected dispenser actuator to a common power driven operating bar. In both systems a similar compact parallel motion operating bar has been used. In mechanical machines its function was to collect the motion from any operating slide to control a lock mechanism and provide various operating motions and resetting of the mechanism. In electrical controls the operating bar is functioning somewhat the opposite way: it is driven by a common power source and it is acting as a motion distributor through a coupling mechanism to actuate a selected dispenser.

Though similar coupling systems are in existence, it is the novel arrangement of the components and the addition of the coupler switch 53 which makes the coupler suitable for a control system where the selection control is a simple series connected switch chain. The four illustrated coupler applications of the basic mechanism in FIG. 11 are demonstrating the flexibility of modifying the coupler 45 and the slide 44 to suit each particular application. In FIGS. 4 and 27 the coupler 45 was also used as a drive pawl for ratcheting action and the slide 44, which in basic terms is a pivoting member, was used also as a bellcrank in FIG. 17. It furter could be combined with shuttling frame of FIG. 16 and it can act as the two-pivot escapement lever for can dispensers.

The main contributing factor to the compactness of the coupling mechanism is the stationary solenoid 48 and its right angle position to the operating motion which permits the convenient resetting of the coupler mechanism throughout the return stroke of the operating bar. This compact arrangement in turn permits a light construction of dispenser trays 70 where the mechanism and wiring can be neatly hidden underneath or between dispenser modules without occupying much cabinet space. The compactness and the flexibility of filling the vending cabinet with the dispenser modules and trays most suitable for a product group are again the contributing factors to get a low PC ratio as this new term was discussed before.

The electrical coupling mechanism finds its main use in solid product dispensers, but many other control mechanisms require an electrically selectable power stroke coupler. Cold beverage vending machines for instance have an application where the coupling mechanism could be used to couple the power stroke of a single drive motor selectively to a number of different stroke operated syrup pumps.

The various features of the control and dispensing mechanisms, as they were shown in many different modifications, can suggest different detail modifications and combinations to those skilled in the art and therefore the invention is limited only by the scope of the following claims:

I claim:

1. An electrically controlled multiple coupling mechanism for selective coupling of an oscillating motion comprising of an electric motor with an output shaft and more than one coupling mechanisms each including an electrical actuator, a coupler switch, a selector switch and a pivoting member with a coupler movably secured to said pivoting member, said output shaft having means for transmitting each revolution of it to a full oscillation of an operating bar, said mechanism having a standby position where a cycle switch, controlled by said output shaft, is keeping said motor deenergized and said operating bar with all of said pivoting members in one of their extreme positions, said coupler having a spring or gravity bias tending to move it from a nonactive position to a coupled position, said actuator having a gravity or spring biased armature normally holding said coupler in said nonactive position, a closing of said selector switch completing a circuit through said cycle and said coupler switch to energize said actuator for releasing said coupler to said coupled position, said releasing causing a switchover of said coupler switch for interrupting the circuit of said actuator and completing a starting circuit to said motor, the rotation of said output shaft actuating said cycle switch for maintaining a circuit of said motor throughout said cycle, half of said oscillation moving said coupler together with said pivoting member to a position to clear said armature for restoring its standby position, the second half of said oscillation moving said pivoting member together with said coupler back to said standby position letting said armature restore said nonactive position of said coupler and said coupler switch before said cycle switch is stopping said motor, the restored position of said coupler switch preventing a restart of said cycle if said control circuit is broken by said selector switch or by any other circuit interrupter in the circuit of said actuator.

2. An electrically controlled multiple coupling mechanism according to claim 1 wherein all of said coupler switches and all of said selector switches are forming a series connected switch chain where all of said selector switches are grouped to the end of said switch chain; the actuation of one of said selector switches and the following switchover of said coupler switch disabling all of said selector switches and allowing the coupling of only one of said couplers to said operating bar for transmitting the oscillation of said operating bar once to said pivoting member.

3. An electrical control system where more than one of said multiple coupling mechanisms of claim 1 being electrically linked together in a grouped series arrangement where all of said selector switches being grouped to the end of a switch chain, all of said cycle switches being grouped to the beginning of said switch chain and all of said coupler switches being grouped in the middle of said switch chain; the actuation of one of said selector switches and the following switchover of said coupler switch disabling all of said selector switches and said coupler switch which was selected by said actuator acting to start said drive motor in same unit where said actuator was located, said motor transmitting the oscillation of said operating bar once to said pivoting member.

4. An electrical control system according to claim 1 wherein all said cycle, coupler and selector switches of one or more said multiple coupling mechanisms have a series connection with each other and with an open relay contact placed between said cycle switches and said coupler switches, said open contact disabling all of said selector switches, said contact forming an holding circuit to said relay through said cycle switches when said relay is receiving a validation pulse from any source, said closed relay contact permitting an actuation of one of said actuators for starting the cycle of one of said motors, the actuation of one of said cycle switches breaking said holding circuit of said relay and preventing the selection of a new cycle without a new validation pulse.

5. An electrical control system according to claim 1 wherein said cycle, coupler and selector switches of one or more of said multiple coupling mechanisms have a series connection with each other and with an open relay contact placed between said cycle switches and said coupler switches, said open contact disabling all of said selector switches, said contact forming an holding circuit to said relay through said cycle switches and through a parallel circuit with one or more series connected normally closed delivery switches when said relay is receiving a validation pulse from any source, said closed relay contact permitting an actuation of one of said actuators for starting the cycle of one of said motors, a simultaneous actuation of one of said cycle switches and said delivery switches breaking said holding circuit of said relay and preventing the selection of a new cycle without a new validation pulse, the opening of one of said delivery switches registering a desired action of one of said coupler mechanisms, a lack of said desired action permitting repeated selections until said desired action is reached.

6. An electrical control system according to claim 1 wherein said cycle, coupler and selector switches of one or more or said multiple coupling mechanisms have a series connection with each other and said circuit includes a multiposition switch permitting a grouping of said acutators for connecting one or more of them to each position of said switch, said grouping permitting the energization of only one of said actuators which is in a connected position of said multiposition switch.

7. An electrically controlled multiple coupling mehcanism according to claim 1 wherein said electrical actuator being a stationary solenoid and said armature a spring or gravity operated plunger of said solenoid acting with said coupler as a three dimensional mechanism.

8. An electrically controlled multiple coupling mechanism according to claim 1 wherein said electrical actuator being a stationary electromagnet with a spring or gravity operated armature controlling a moving member acting at right angles to the motion of said operating bar, said moving member acting to reset and hold said coupler in said nonactive position and to release it to said coupled position only when it is energized by said selector switch.

9. An electrically controlled multiple coupling mechanism according to claim 1 wherein said operating bar has a parallel motion and all of said pivoting members together with said couplers have a superimposed arrangement and a selective coupling capability to said operating bar.

10. An electrically controlled multiple coupling mechanism according to claim 1 wherein said operating bar has a parallel motion and all of said pivoting members together with said couplers have a superimposed arrangement and a selective coupling capability to said operating bar, said parallel motion being controlled by a one plane parallelogram-type of linkage including two bellcranks pivotally secured to a base plate, a connecting link for connecting two arms of said bellcranks and said operating bar connected to the other arms of said bellcranks, any member of said parallel motion linkage having a link connection to a crankpin rotated by said output shaft, said linkage transmitting one revolution of said output shaft to a full oscillation of said operating bar.

11. An electrically controlled multiple coupling mechansim according to claim 1 wherein said operating bar has a straightline oscillating motion and all of said pivoting members together with said couplers being placed next to each other on same plane with said operating bar, said oscillating motion being generated by each revolution of said output shaft, said operating bar having individual coupling points for each said coupler for transmitting said oscillation selectively to one of said pivoting members.

12. An electrically controlled multiple coupling mechanism according to claim 1 wherein said couplers having another arm acting as a drive pawl for an indexing wheel having equally spaced teeth and restricted to move in one direction, said drive pawl being not in full contact with said teeth in said nonactive position, said drive pawl moving to a full drive contact in said coupled position, said indexing wheel being advanced by said pawl a full increment during the first half of said oscillation, said mechanism providing a selective indexing drive to one of said indexing wheels.

13. An electrically controlled multiple coupling mechanism according to claim 1 wherein said couplers having another arm acting as a drive pawl for an indexing wheel having three drive pins equally spaced and concentric to the center of said indexing wheel, said pivoting member carrying a 120° segment in a working contact with said three pins and acting as a motion translating means between said pivoting member and said indexing wheel, said drive pawl being engageable to one of said drive pins in said coupled position, said operating bar transmitting the first half of said oscillation to a 60° motion of said pivoting member and to a 120° indexing of said indexing wheel, the second half of said oscillation acting to reset said coupler while said segment and said drive pins are maintaining the position of said indexing wheel throughout the return stroke of said pivoting member, said mechanism providing a positive and selective indexing drive to one of said indexing wheels.

14. An electrically controlled multiple coupling mechanism according to claim 1 wherein said coupler having another arm acting as a drive pawl for an indexable conveyor belt, said conveyor belt being provided with equally spaced partitions for transporting and dispensing articles placed between said partitions, said belt having a supporting framework with a drive station where said drive pawl can move to a full drive contact with one of said partitions in said coupled position, the first half of said oscillation causing said coupled drive pawl advance said belt one full pitch length as determined by said partitions, the advancement of said conveyor belt being usable for dispensing one article per each oscillation of said operating bar.

15. An electrically controlled multiple coupling mechanism according to claim 1 wherein said pivoting member is providing an oscillating motion for indexing a sprocket wheel used to advance a partitioned conveyor belt, said conveyor belt being usable for dispensing one article per each oscillation of said operating bar.

16. An electrically controlled multiple coupling mechanism according to claim 1 wherein said pivoting member acting as a two-pivot escapement lever for dispensing force fed products from a storage chute, said escapement lever having a first and second pivot point and a restriction controlling a pivoting sequence wherein said first pivot point will act during the first half of said pivoting sequence and said second pivot will act during the second half of said pivoting sequence, said escapement lever representing said pivoting member with said coupler during the first half of said pivoting sequence for providing a selective coupling to said operating bar, said operating bar and said escapement lever having a secondary meshing connection staying in full mesh throughout the second half of said pivoting sequence, said two-point coupling transmitting said full oscillation of said operating bar to a full reciprocating pivoting sequence of said escapement lever for releasing one of said products per each of said oscillation.

17. An electrically controlled multiple coupling mechanism according to claim 1 wherein said pivoting member having a link connection to a two-pivot escapement lever for selectively actuating a dispenser mechanism controlled by said escapement lever.

18. An electrically controlled multiple coupling mechanism according to claim 1 wherein said pivoting member is providing a selective oscillating motion for actuating various dispensing mechanisms for dispensing one article from a selected storage column of a multiple storage unit per each of said oscillation.

19. A manually operable merchandise vending machine having an enclosure with a number of horizontal dispensing trays each having a series of dispensers with a front end dispensing mechanism and display location, each said dispenser having an operating lever operable by a vertical oscillating motion, said enclosure having a door with transparent areas for providing visibility to all of said display locations, said door having vertical support sections between said transparent areas with guide slots for a series of knobs on the outside of said door and for operating slides on the inside of said door connected to said knobs through said guide slots, said operating slides being grouped and in a vertical alignment with said operating levers, said operating slides and said operating levers having a coupling including a lost motion, said coupling providing a connection between said operating knobs and said operating levers when said door is closed, said coupling permitting a separation of said connection during an opening of said door; all of said operating slides being controlled and controlling a common coin operated lock mechanism with a free sensing motion up to a lock-point and an operating motion after said lockpoint, said sensing motion equalling said lost motion and said operating motion being transferable to said operating lever of each said dispenser to perform a manually operated dispensing action from any dispenser in said enclosure which is operable by an oscillating motion.

20. A dispensing mechanism operable by an oscillating motion for dispensing odd shape articles from a storage structure, said storage structure including a supporting platform for an endless partitioned conveyor belt, said partitions having a uniform pitch and said conveyor belt acting as a transporting and dispensing means for said articles placed between said partitions, said platform having a horizontal or inclined position, said platform having a rounded front and rear end for guiding said endless belt, said front end guiding means having a radius not exceeding half of said pitch, said belt having an indexing feed operable by said oscillating motion for advancing the top side of said belt toward said front end one pitch length per each oscillation, said belt releasing one of said articles per each said oscillation over said front end.

21. A dispensing mechanism according to claim 20 wherein said storage structure is supporting a barrier plate placed next to said front end with a clearance not less than the thickness of said articles dispensable by said endless belt and with an angular relationship to said storage platform less then 90°, said barrier plate permitting an upright placement of said articles between said partitions in a way that said foremost article being in said dispensing and display position leaning against said barrier plate and the next articles being also placed between said partitions leaning against each other, each of said indexing of said belt removing bottom hold of said foremost article to permit its fall to a delivery location.

22. A dispensing mechanism according to claim 20 wherein said oscillating motion to advance said conveyor belt being provided by a manual reciprocation of an operating means.

23. A dispensing mechanism operable by an oscillating motion for dispensing solid rectangular containers from a storage structure, said containers having a forced feed toward a dispensing station, said storage structure and said dispensing station consisting of a chute for said containers, a barrier plate and a shuttling frame all with same size opening to clear said containers, said chute and said barrier plate being stationary and in an angularly offset relationship while said shuttling frame being pivotally secured between them, said shuttling frame being in alignment with said chute in one of its extreme positions and in alignment with said barrier plate in the other of its extreme positions, said forced feed causing an advancement of said containers when said shuttling frame is moved to an alignment with said chute and another advancement and a release of one of said containers when said frame is moved to an alignment with said opening in said barrier plate, said frame and said opening in said barrier plate having their bottom open to permit a free fall of said dispensed container, said oscillating motion pivoting said shuttling frame once back and forth to accomplish one dispensing action per each said oscillation.

24. A dispensing mechanism for solid uniform shape merchandise according to claim 23 wherein said oscillating motion being provided by manual operating means which can simultaneously operate a control mechanism.

25. A dispensing mechanism for solid uniform shape merchandise according to claim 23 wherein said forced feed being provided by a pusher plate guided by said storage structure and spring loaded toward said dispensing station.

26. A release mechanism operable by an oscillating motion for releasing force fed items in a controlled way through a release station, said mechanism having a supporting and guiding structure for said items and for a two-pivot escapement lever in said release station, said escapement lever having a first and second pivot point with a centerdistance suited to the size of said items, both of said pivot points representing means to extend to the path of said items for providing a holding position to said items, said pivot points having a midposition where both of said pivot points are in said holding position, said pivot points having means to control a restricted pivoting sequence from said midposition to either one of two extreme or release positions, said oscillation moving said escapement lever through said restricted pivoting sequence in the following order: a standby position as being one of said extreme positions, said midposition, the other of said extreme positions, said midposition and said standby position again, said pivoting sequence permitting an advancement of said items when one of said pivot points is reaching said release position and a release of one of said items per each said oscillation.

27. A release mechanism for force fed items according to claim 26 wherein said supporting structure being an inclined plane chute with a sideplate providing a support, guidance and said restriction to control said pivoting sequence of said escapement lever, said pivot points being means working in arched guideslots in said sideplate and said restriction being provided by two corner points, one in said sideplate and the other one in said escapement lever, said chute providing a gravity feed to said items and said two pivot points following said restricted pivoting sequence to release one of said items per each said oscillation.

28. A release mechanism for force fed items according to claim 26 wherein said supporting structure being a first and second deck inclined plane chute for rolling containers, said structure having a sideplate to provide a support guidance and said restriction to said escapement lever, said release station with said escapement lever being on said first deck, said second deck having a pivoting platform to guide said containers from said second deck to said release station when said first deck is empty, said platform resting normally on top of the container in said release station, said platform being lifted slightly by the motion of a connecting link which is pivotally secured to said escapement lever, said motion taking place after said midposition has been reached, said lifting permitting a free rolling action from said first deck during a release or dispensing sequence.

29. A release mechanism for force fed items according to claim 26 wherein said supporting structure having two sideplates each providing a support guidance and said restriction to control said pivoting sequence of said escapement levers, said escapement levers having tie-in means representing said two pivot points for forming an escapement frame guided by said two sideplates, said oscillating motion having a connection to at least one of said escapement levers to move said pivot points through said operating sequence and provide a dispensing of one of said items per each said oscillation.

30. A release mechanism for force fed items according to claim 26 wherein said restricted pivoting sequence being controlled and guided by a connecting link and two restricting corners between said escapement lever and said supporting structure, said connecting link providing a connection from the first of said pivotpoints of said escapement lever to said supporting structure with a pivot point in line or close to the location of said second pivot point of said escapement lever as taken in said midposition.

31. A release mechanism for force fed items according to claim 26 wherein said restricted pivoting sequence being controlled by two connecting links each having one of the ends connected to said first and second pivot points of said escapement lever and each said connecting link having its other end pivotally secured to said supporting structure in line with said second and first pivot points of said escapement lever as taken in said midposition.

32. A release mechanism for rolling containers according to claim 26 wherein said oscillating motion being provided by a solenoid and a return spring in a multidispenser unit where each said release mechanism being controlled by said solenoid, a selector switch for said solenoid and a resetting switch; all of said switches having a series connection with each other and with a normally open relay contact placed between a group of said resetting switches and said selector switches, each of said selector switch being capable to energize its solenoid only after said relay contact was closed by a validation pulse, said relay contact forming a holding circuit to said relay coil through the chain of said resetting switches, one of said resetting switches breaking said holding circuit as soon as one of said released containers is overriding and actuating said resetting switch momentarily, said broken holding circuit deenergizing said solenoid and letting said return spring complete the second half of said oscillation, said solenoid powered oscillation dispensing one of said containers per each said oscillation.

33. A release mechanism for force fed items according to claim 26 wherein said escapement lever having an operating arm and said oscillating motion motion being provided by a manually operable reciprocating member connected to said operating arm.

34. A release mechanism for force fed items according to claim 26 wherein said supporting structure being a delivery box and said two-pivot escapement lever acting within said delivery box as a barrier plate and door to a delivery opening to permit a passage of articles and prevent access through said delivery box, said delivery box being formed by a vertical wall containing said delivery opening and by a U-shape structure with two side plates and a delivery platform around said delivery opening, said sideplates providing a support, guidance and restriction to control said pivoting sequence of said barrier plate, said barrier plate having an operating arm acting as said door to cover said delivery opening and a U-shape section between said first and second pivot points above said delivery opening, said U-shape section forming a closed pocket in said midposition when both of said pivot points are against said wall, said pocket being suited to the size of said articles and said pocket having its top open in said standby position where said door is keeping said delivery opening closed, a push of said door through said delivery opening and a gravity or spring actuated return of said barrier plate acting as said oscillating motion to move said barrier plate through said restricted pivoting sequence from said standby position, said restricted pivoting sequence keeping at least one of said pivot points of said barrier plate close to said wall to prevent an access through said delivery box, said standby position permitting an entrance of said article to said pocket and said pivoting sequence letting said article fall to said delivery platform for pickup through said delivery opening.

* * * * *